US005586645A

United States Patent [19]

Bartok

[11] Patent Number: 5,586,645

[45] Date of Patent: Dec. 24, 1996

[54] EXPANDING HELICAL RATCHET SWITCH

[76] Inventor: Stephen Bartok, 5687 Mistridge Dr., Rancho Palos Verdes, Calif. 90274

[21] Appl. No.: 561,082

[22] Filed: Nov. 20, 1995

Related U.S. Application Data

[63] Continuation of Ser. No. 258,944, Jun. 13, 1994, abandoned.

[51] Int. Cl.[6] ..... H01H 19/62

[52] U.S. Cl. ..... 200/527; 200/526; 200/529

[58] Field of Search ..... 200/526, 527, 200/528, 529, 523; 74/817, 128

[56] References Cited

U.S. PATENT DOCUMENTS

| | | | |
|---|---|---|---|
| 3,223,072 | 12/1965 | Bross | 200/526 |
| 3,654,413 | 4/1972 | Jorden et al. | 200/156 |
| 4,319,106 | 3/1982 | Armitage | 200/526 |
| 4,906,808 | 3/1990 | Burgess et al. . | |
| 4,939,320 | 7/1990 | Smith | 200/527 |
| 5,132,449 | 7/1992 | Valenzona et al. | 200/527 |
| 5,226,529 | 7/1993 | Valenzona | 200/529 |

*Primary Examiner*—David J. Walczak
*Attorney, Agent, or Firm*—G. Norden Hanover

[57] ABSTRACT

A quiet smooth acting push button switch, which permits partial actuation without a change of state, including a body, a cover and a contact cup having one or more tabs, the cup rotatibly mounted on the cover. A plunger, actuator and a ratchet with radially expanding helical camming ramps are mounted in the body, which incrementally rotate the contact cup and tabs upon successive actuations of the switch. Two terminals mounted on the cover are interruptably in contact with the tabs as the tabs are rotated during switch operation. The actuator may be a pawl, bail or a resilient portion of the plunger and has at least one hook for engaging a helical camming surface of the ratchet and rotatibly driving the rachet in response to a depression and release of the plunger.

23 Claims, 7 Drawing Sheets

FIG. 14
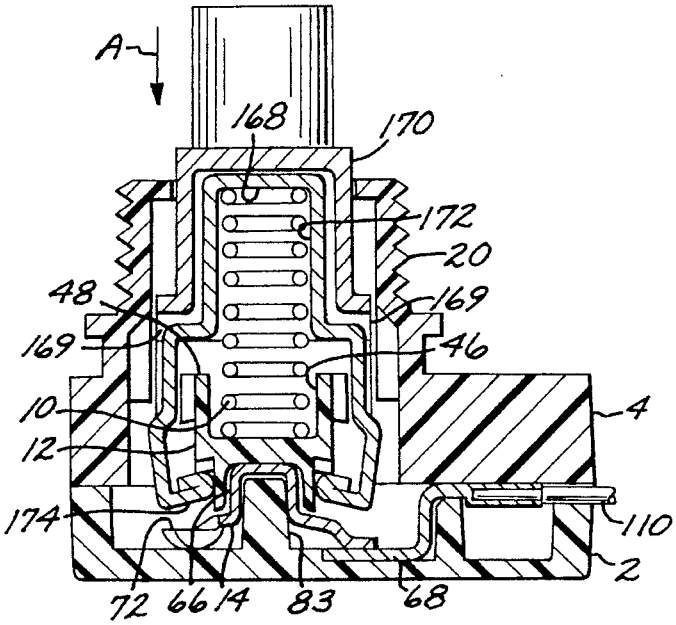
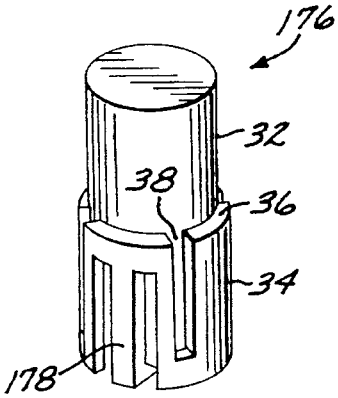
FIG. 16
FIG. 15
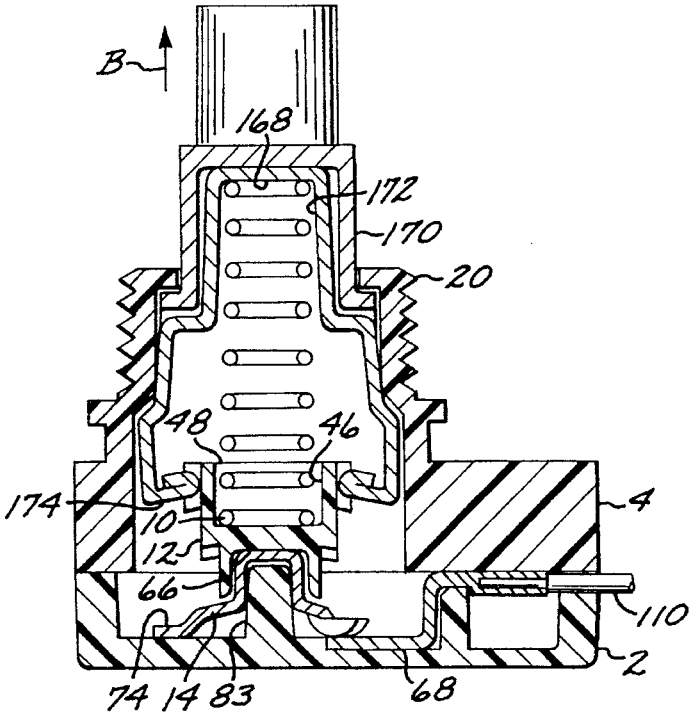
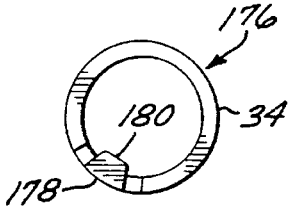
FIG. 17

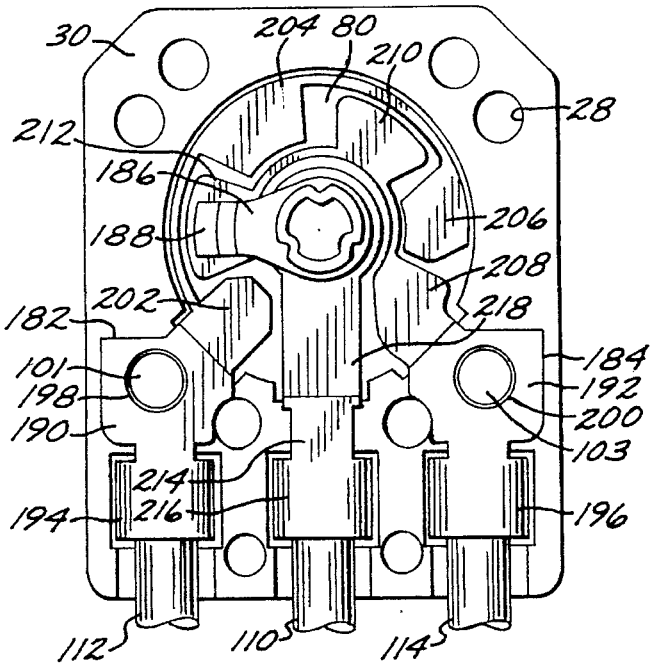
FIG. 18
FIG. 19
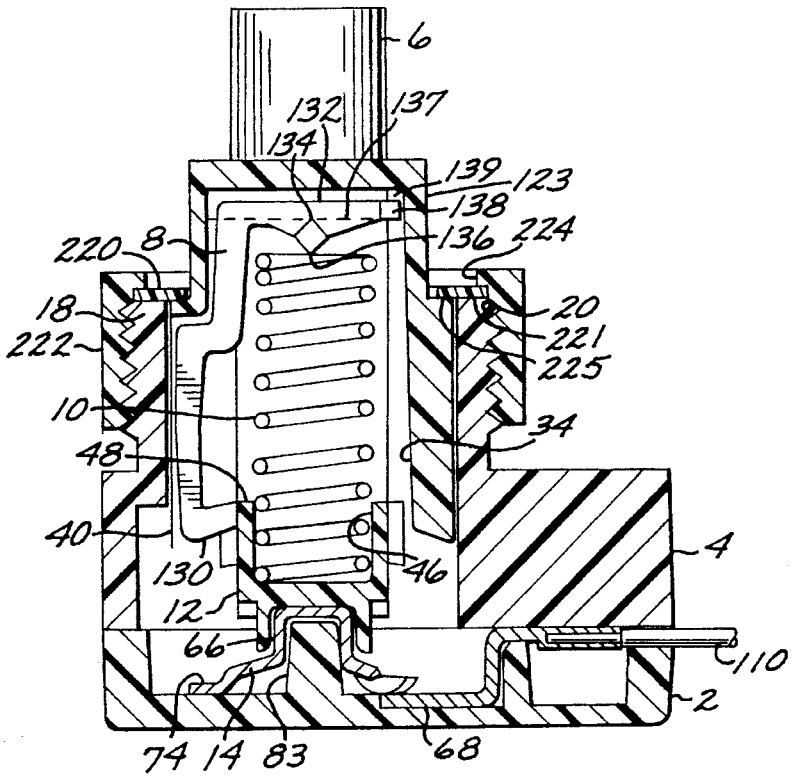

EXPANDING HELICAL RATCHET SWITCH

CONTINUATION OF PRIOR APPLICATION

This application is a continuation of the application having Ser. Ser. No. 08/258,944 filed on Jun. 13, 1994, now abandoned.

FIELD OF THE INVENTION

The present invention relates to push button electrical switches and in particular to a switch having an expanding helical rachet which exhibits a quiet, smooth, "tease free" operating characteristic.

BACKGROUND OF THE INVENTION

Push button switches are well known in the art and numerous examples thereof may be found in commerce. Typically, a push button switch is adapted to sequentially open and close an electrical circuit or to sequentially switch a common lead between two or more alternate circuits upon depression and release of its plunger.

A perceived problem with many types of push button switches is an instability caused when the plunger is partially actuated. If in the closed state, a less than full depression of the plunger may cause the switch to momentarily open. Upon release of the plunger, the switch returns to its original closed state. This problem is often found in automotive applications, where push button switches are mounted in cosmetic housings having an actuating button. During assembly, tolerance stacking of the mounting components may cause the housing button to hold the switch plunger in a partially actuated position. External vibration may then cause the switch to intermittently open when it is in the closed state. This problem has been overcome by ratchet tease free push button switches, such as taught by U.S. Pat. No. 5,226,529.

Another perceived problem with many push button switches, including ratchet tease free switches, is the snapping action of the switch as it changes from one state to another. This results in a popping sound, which may be amplified when the switch is mounted in an enclosed housing. In many applications a quiet, smooth actuation is preferred. Heart and bail push button switches provide the desired quiet and smooth actuation but, but are not known to be tease free.

There is, therefore, a need for a quiet, smooth acting, tease free push button switch.

SUMMARY OF THE INVENTION

According to the present switch invention, the foregoing and other desired characteristics and advantages are achieved. In its presently preferred embodiment, the switch includes a body having a barrel portion and a cover. The cover has an axial post extending away from the cover into the barrel. Two terminals are mounted in the cover, connectable to an external electrical circuit. A contact cup is rotatibly mounted on the axial post, its open end having one or more tabs extending radially outward from its circumference. The tabs interruptably communicate with both the terminals, alternately completing and interrupting a circuit between them. A ratchet, actuator, plunger and spring are also mounted within the housing. The rachet is engaged with the contact cup and includes a plurality of radially expanding helical camming surfaces. The actuator may be a pawl, bail or a resilient portion of the plunger. The actuator has at least one hook for engaging a camming surface of the ratchet and rotating the rachet and the cup. A portion of the plunger projects through the barrel portion and is used to drive the actuator. The spring applies a biasing force which urges the plunger outward from the housing and the contact cup tabs into communication with the terminals.

Other features and advantages of the present invention will become readily apparent to those skilled in this art from the following detailed description; wherein this and other presently preferred embodiments of the invention are shown and described simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature and not as restrictive.

BRIEF DESCRIPTION OF THE DRAWINGS

The features and advantages of this invention are more fully set forth in the following description of the presently preferred embodiments. The description is presented with reference to the accompanying drawings in which:

FIG. 14 is a sectional view of another embodiment of the present invention taken along line 11—11 of FIG. 1, with the plunger shown fully depressed;

FIG. 15 is a sectional view of the switch shown in FIG. 14, with the plunger in the fully extended position;

FIGS. 16 and 17 are a perspective and bottom view of an actuator plunger adapted for use with the switch of FIG. 1;

FIG. 18 is a top plan view of the cover portion of another embodiment of the present invention; and FIG. 19 is a sectional view of another embodiment of the present invention taken along line 11—11 of FIG. 1, with the plunger shown in the fully extended position.

DETAILED DESCRIPTION

The present invention provides a push button switch in which a ratchet and actuating mechanism is utilized to change the state of the switch. In operation the actuator, such as a pawl, engages a camming surface of the ratchet thereby translating a linear motion of the pawl to a rotary motion of the ratchet; the linear motion of the pawl being provided by the operator of the switch and the rotary motion of the ratchet being utilized to make and break electrical connections between terminals within the switch.

Figure 1:
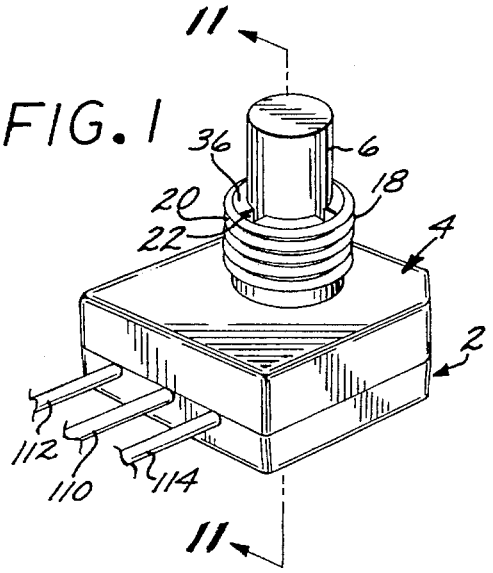
FIG. 1 is a perspective view of a presently preferred embodiment of the invention.
Figure 2:
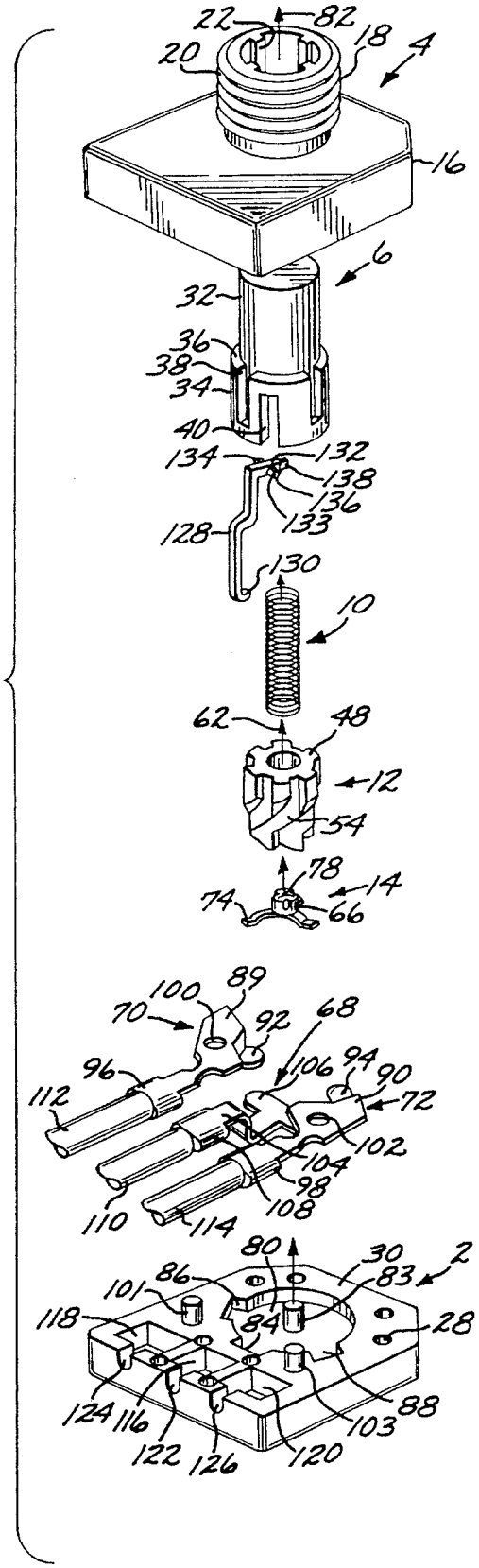
FIG. 2 is an exploded, perspective view of the switch of FIG. 1.

Referring to FIGS. 1 and 2, there are shown perspective and exploded views of a preferred embodiment of the present invention. This embodiment includes separable housing portions comprising a cover 2 and a body 4. Within the body 4, a plunger 6, a pawl 8, a helical spring 10, a rachet 12 comprised of one moving element and a contact 14 are disposed. The cover 2, body 4, plunger 6 and pawl 8 may be made of any of several plastic materials with nylon or acetal being presently preferred. The spring 10 may be made of stainless steel or carbon steel with a corrosion resistant coating such as zinc or tin.

Figure 3:
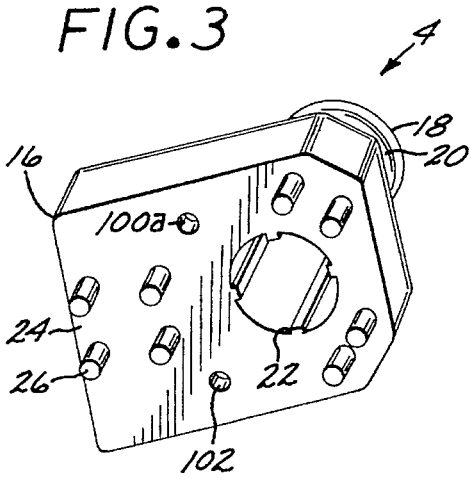
FIG. 3 is a perspective view of a body portion of the switch shown in FIGS. 1 and 2.

Referring to FIGS. 2 and 3, the body 4 has a planar portion 16 and a barrel portion 18. The barrel 18 is generally cylindrical in shape, open at both ends and may optionally have threads 20 on its exterior surface. A plurality of ribs 22 are disposed longitudinally on the interior surface of the barrel 18. Four equally spaced ribs 22 are preferred in this embodiment, but more or less may be utilized.

The planar portion 16 is provided with a mating surface 24. A plurality of spaced pin members 26 extend perpendicularly away from the mating surface 24, with eight pin members 26 being presently preferred. The pin members 26 are generally disposed over the mating surface 24 and are engagable with recesses 28 correspondingly located in a conforming surface 30 of the cover 2, as described below.

Figure 4:
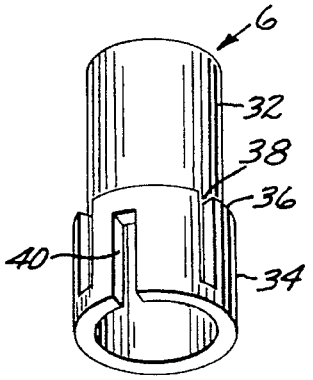
FIG. 4 is a perspective view of a plunger adapted for movement within the body portion of the switch shown in FIGS. 2 and 3.

Referring to FIG. 4, the plunger 6 is generally cylindrical in form and has two portions; a relatively smaller diameter closed ended portion 32 and a relatively larger diameter open ended portion 34. A shoulder 36 is formed by the junction of the closed ended and open ended portions 32 and 34, respectively. The plunger 6 is adapted for axial sliding movement within the barrel 18.

The exterior surface of the closed ended portion 32 has a plurality of grooves 38 disposed longitudinally along a portion of its exterior surface adapted in number and form for engagement with the ribs 22. The engagement of the ribs 22 and grooves 38 prevents rotational movement of the plunger 6 within the barrel 18 and limits the extension of the closed end portion 32 out of the barrel 18. When plunger 6 is fully inserted into the barrel 18, the closed ended portion 32 projects sufficiently out of the barrel 18 to provide an actuating button for operation of the switch.

The open ended portion 34 contains a longitudinal wall slot 40 extending through its sidewall from adjacent to the shoulder 36 to its open end. Wall slot 40 prevents the pawl 8 from rotating during operation of the switch, as described below.

Figure 5:
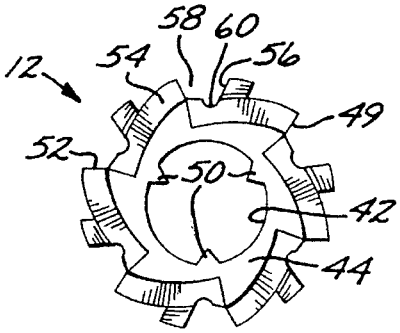
FIGS. 5–7 are bottom, perspective and top views, respectively, of a rachet adapted for insertion within the plunger shown in FIGS. 2 and 4.
Figure 6:
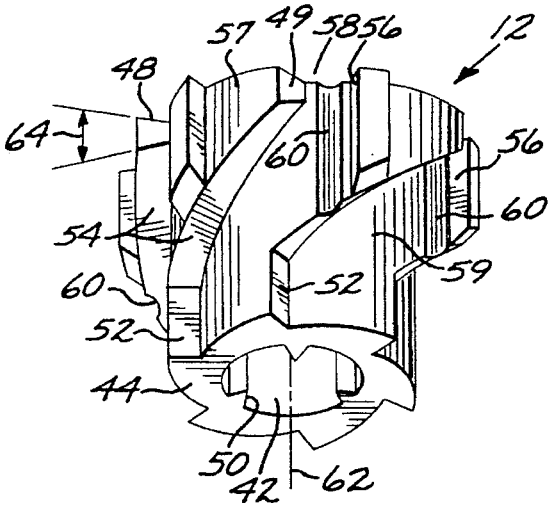
Figure 7:
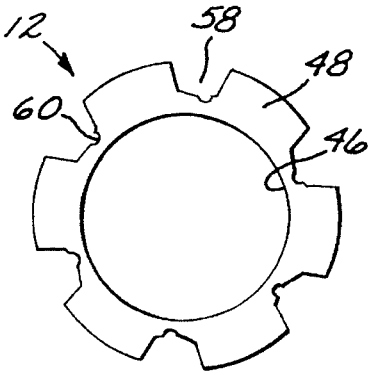

Referring to FIGS. 5–7, the ratchet 12 has a generally frustum shaped body with its exterior formed into a plurality of surfaces and its interior formed into two nonconnecting cylindrical surfaces. The first cylindrical interior surface 42 extends axially from near the center of the ratchet 12 through a relatively smaller diameter end portion 44. The second cylindrical interior surface 46 extends axially from near the interior end of the first cylindrical interior surface 42 through a relatively larger diameter end portion 48. The end portions 44 and 48 are approximately coplaner and perpendicular to a central axis 62 of the ratchet 12. A plurality of triangular ribs 50 are disposed longitudinally on the first interior surface 42, with three equally spaced ribs 50 being presently preferred.

The exterior of the ratchet 12 is formed into a plurality of terminating faces 52, radially expanding helical camming surfaces 54, stops 56, openings 58 and optional recesses 60. Six of each, spaced equally around the exterior of the ratchet 12 is preferred in this embodiment, but the number utilized may be more or less, depending upon the degrees of rotation desired from each actuation of the switch.

The surfaces of terminating faces 52 and stops 56 are formed in approximate radial and axial alignment with the axis 62. As viewed in FIG. 6, the terminating faces 52 extend upward from the smaller end portion 44 and the stops 56 extend downward from the larger end portion 48, each being of sufficient length to prevent rotation of the ratchet past the pawl 8, as described below.

Camming surfaces 54, are formed between an outer sidewall 57 and an inner sidewall 59. The camming surfaces 54 form a radially expanding helix from the terminating faces 52 towards the larger end portion 48, with terminations 49 located a distance from the stops 56 to form the openings 58. The openings 58 must be of a sufficient size to allow the pawl 8 to fit therein. In the presently preferred embodiment each termination 49 is axially in line with a portion of the adjacent camming surface 54, resulting in each camming surface 54 rotationally overlapping a portion of both of its adjacent camming surfaces 54. The camming surfaces 54 are preferably formed to have a surface angle 64 of greater than 0 degrees to the end portion 48. Angles of between 3 and 15 degrees are presently preferred, but they may be larger or smaller. Recesses 60 are optional providing, together with stops 56, a guiding track for the pawl 8 during switch operation. When recesses 60 or other means are present to provide a guiding track for the pawl 8, the camming surfaces 54 need not overlap.

Figure 8:
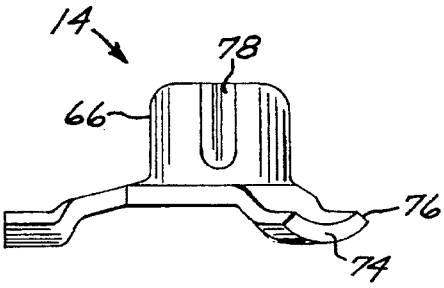
FIGS. 8 and 9 are side and top views of a contact cup adapted for insertion into the rachet shown in FIGS. 2 and 6.
Figure 9:
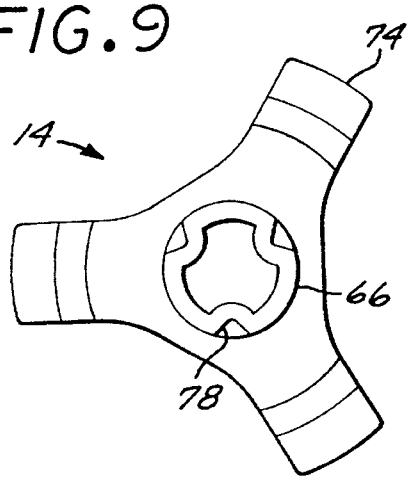

Referring to FIGS. 2, 8 and 9, the contact 14 is made of a conductive material such as 70/30 cartridge brass or the like and is adapted for rotation to make and break electrical connections between a common 68 and a left 70 or a right 72 terminal, as described more fully below. The contact 14 is generally triangular in form with a cup shaped center bearing portion 66. The open end of the bearing portion 66 has several tabs 74, extending radially outward from the circumference thereof. In the presently preferred embodiment, three radial tabs 74 are evenly spaced around the circumference. During switch operation, the tabs 74 engage in wiping contact with a portion of the center 68, left 70 and right 72 terminals. The tabs 74 are provided with radiused edges 76 to prevent galling the terminals when making wiping contact with them.

Figure 10:
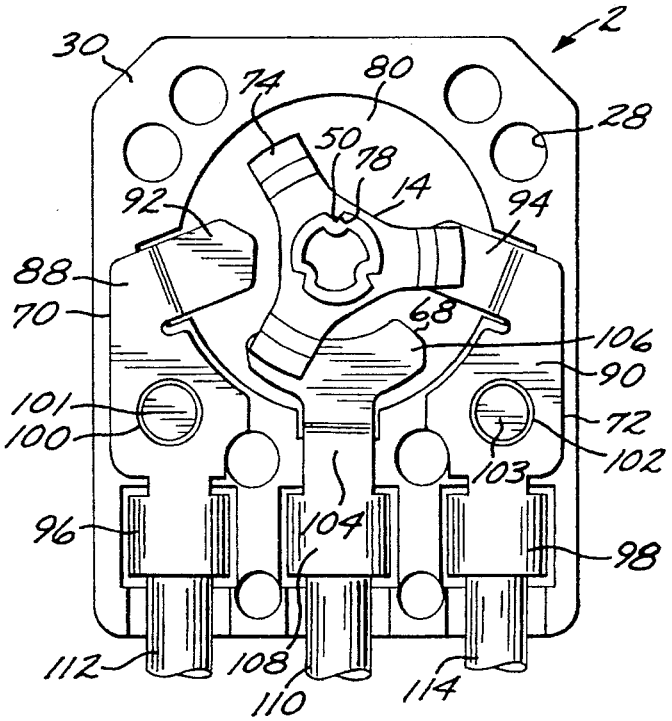
FIG. 10 is a top plan view of the cover portion of the switch shown in FIGS. 1 and 2.

The bearing portion 66 is provided with a plurality of elongated axial V-shaped grooves 78 on its external surface and is adapted to be inserted into the first interior surface 42 of the ratchet 12. The grooves 78 are of the same number and are adapted to mate with the triangular ribs 50 within the first interior surface 42. The mating of the ribs 50 and grooves 78 causes the rachet 12 and contact 14 to rotate as a single unit. As depicted in FIG. 10, the tabs 74, ribs 50 and grooves 78 are aligned such that after each full actuation of the switch, one of the tabs 74 is at rest in communication with the center terminal 68, while one of the other tabs 74 is at rest in communication with either the left 70 or right 72 terminal.

Referring now to FIGS. 2 and 10, the cover 2 is provided with a plurality of recesses 28 in conforming surface 30. As described above, the recesses 28 are configured and adapted to mate with pin members 26 located in the mating surface 24 of the switch body 4. The cover 2 and the body 4 are held together by means of an interference fit between the pin members 26 and the recesses 28.

An approximately circular recess 80 extends into the conforming surface 30, its center aligned with the ratchet axis 62. An optional central post 83 extends perpendicularly away from the center of the recess 80. Three terminal recesses, a center 84, a left 86 and a right 88 open into the circular recess 80. The left 86 and right 88 terminal recesses are located approximately 67.5 degrees on either side of the center recess 84. Within the center 84, left 86 and right 88 terminal recesses are mounted the common 68, left 70 and right 72 terminals.

The left 70 and right 72 terminals each include, respectively, mounting portions 89 and 90, planar contact portions 92 and 94, crimped end portions 96 and 98, and locating holes 100 and 102. The terminals are held in place between the mating surface 24 and conforming surface 30, the conforming surface 30 being recessed as necessary to conform to the shape of the terminals. The terminals 70 and 72 are further secured in position by locating posts 101 and 103 on the conforming surface 30, which pass through the locating holes 100 and 102, respectively in the mating surface 24. The terminals 70 and 72 are additionally secured in position by a portion of the mounting portions 89 and 90 which descend into and seat in the terminal recesses 86 and 88, respectively. The contact portions 92 and 94 are located in a plane on and are coplanar with the bottom of the circular recess 80, the bottom of the circular recess 80 being recessed as necessary to conform to the shape of the contact portions 92 and 94.

The common terminal 68 has a mounting portion 104, a contact portion 106, and a crimped end portion 108. In the presently preferred embodiment the contact portion 106 is coplaner with and has a relatively larger surface area along the arc described by the tabs 74 than the contact portions 92 and 94 of the left 70 and right 72 terminals, respectively.

As shown in FIG. 2, the crimped end portions 108, 96 and 98 of the terminals are attachable to conventional electrical conductors 110, 112 and 114, respectively, to connect the switch to, for example, a common lead and two portions of an electrical circuit. Crimped end recesses 116, 118 and 120 are located in the conforming surface 30 to provide clearance for the crimped ends 108, 96 and 98. Conductor recesses 122, 124 and 126 are located in the conforming surface 30 adjacent to the crimped end recesses 116, 118 and 120 provide clearance for the electrical conductors 110, 112 and 114, respectively.

Figure 11:
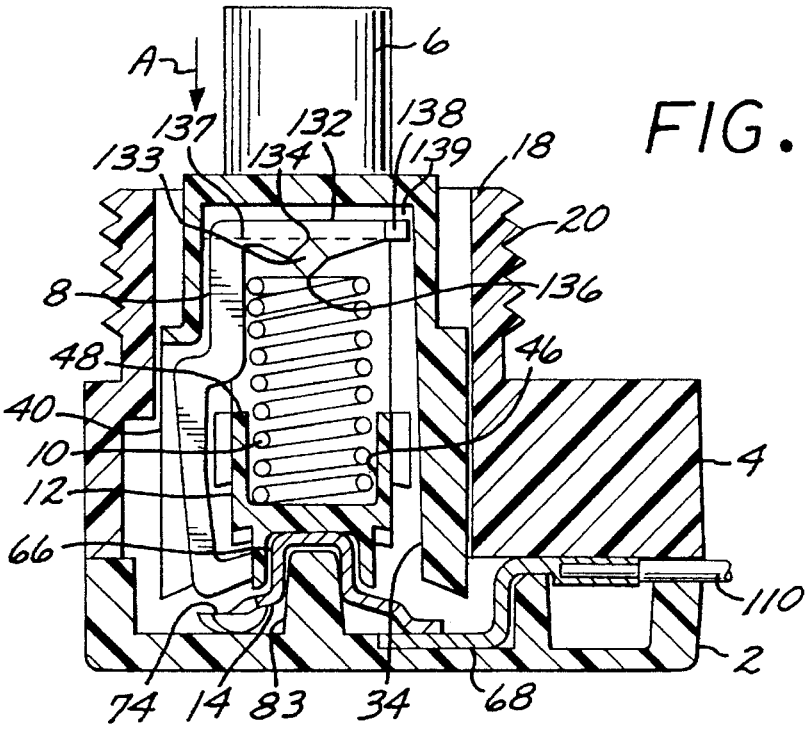
FIG. 11 is a sectional view of the switch shown in FIG. 1 taken along line 11—11, with the plunger shown fully depressed.
Figure 12:
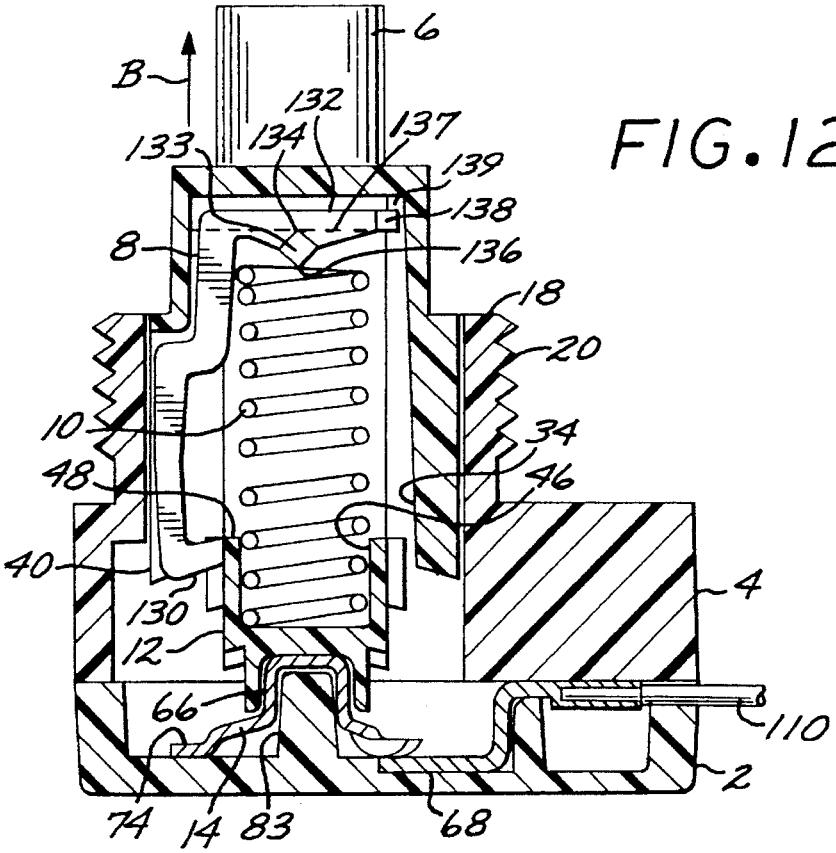
FIG. 12 is the sectional view of the switch shown in FIG. 11, with the plunger in the fully extended position.

Referring additionally to FIGS. 11 and 12, the pawl 8 is a generally L-shaped body having a relatively longer arm 128 and a relatively shorter arm 132. The longer arm 128 has an inner and outer portion, with the outer portion terminating in a hook 130. The outer portion, hook 130 and the shorter arm 132 are aligned in the same plane, while the hook 130 and the shorter arm 132 extend away from the longer arm 128 in the same direction. The shorter arm 132 contains a pivot 133 extending laterally through both of its vertical sides. The pivot 133 has upper pivot edges 134 and lower pivot edges 136. The upper pivot edges 134 rest on plunger shelf 137. The pawl 8 pivots on pivot edges 134 during operation of the switch. The lower pivot edges 136 provide a sharply defined attack point for the force of spring 10. The lateral displacement between pivot edges 134 and 136 transforms the axial force of spring 10 to a torque urging the hook 130 against the ratchet 12, as described below. The shorter arm 132 terminates in a finger 138 which is captured in a plunger internal slot 139.

FIG. 11 shows the switch with the plunger 6 depressed, as indicated by the arrow A, while FIG. 12 depicts the switch with the plunger 6 in the fully extended position, as depicted by the arrow B. When assembled, the plunger 6 is positioned in the barrel 18 and the pawl 8 is inserted into the open end portion 34 of the plunger 6, with the outer portion of the longer arm 128 inserted into the slot 40 of the plunger 6. The spring 10 is inserted into the open end portion 34 of the plunger 6, with the end of the spring 10 resting against the lower pivot edges 136. The other end of the spring 10 is positioned in the second interior surface 46.of the ratchet 12. The ratchet 12 is positioned in the open end portion 34 of the plunger 6 with its relatively larger diameter end portion 48 upward as depicted in FIGS. 11 and 12. The bearing portion 66 of the contact 14 is inserted into the first interior surface 42 of the ratchet 12 and over the optional central post 83 if it is present.

The spring 10 provides a continual force against the ratchet 12, thereby biasing the tabs 74 against the common 68 and one of the left 70 or right 72 terminals. The spring 10 additionally provides a continual force against the pawl 8, biasing the plunger 6 to its furthest extension out of the barrel 18. The spring 10 is preferably sized to provide a resistive force of from 2 to 8 Newtons during the operation of the switch, but stronger and weaker force springs may be used to adjust the "feel" of the switch.

When the switch is operated, one of the tabs 74 is located on the common terminal 68 and another tab 74 is, for example, located on the right 72 terminal completing a circuit through the switch between the center 110 and the right 114 conductors, as shown in FIG. 10. The spring 10 is biasing the pawl 8 and the plunger 6, urging the plunger 6 out of the barrel 18 to its fullest extent. The hook 130 is located in one of the openings 58 of the ratchet 12, as shown in FIG. 12.

Referring to FIGS. 6 and 11, switch actuation begins with a downstroke of the plunger 6. During the downstroke, the plunger 6 and the pawl 8 move into the barrel 18 compressing the spring 10. The hook 130 moves towards the smaller end portion 44 of the ratchet 12, traveling along a stop 56 and, if provided, a recess 60 until reaching a camming surface 54. At this point, the force of the spring 10 on pivot edges 136 causes the pawl 8 to rotate on pivot edges 134 moving the hook 130 radially across the camming surface 54 towards the ratchet axis 62. The movement of the pawl is stopped by the inner sidewall 59.

At the end of the downstroke, release of pressure on the plunger 6 initiates an upstroke. During the upstroke, the hook 130, engages the camming surface 54, causing a rotational force to be generated. As a counter rotational movement of the pawl 8 is prevented by the confines of the wall slot 40 and the internal slot 139, the rotational force causes the ratchet 12 and contact 14 to pivot within recess 80 about the central post 83 if present. During the continuation of the upstroke, the hook 130 continues to engage the camming surface 54, resulting in continued rotation of the ratchet 12 and contact 14. Rotation ceases when the hook 130 comes to rest in the opening 58 adjacent to that in which it was located at the beginning of the downstroke.

Referring again to FIG. 10, the angular rotation of the rachet 12 and contact 14 is about 60 degrees after each full operation of the plunger 6. During this rotation a first of the three tabs 74, which was initially located on the common terminal 68, is rotated to the left terminal 70; while a second tab 74, initially located at a first position between the left 70 and right 72 terminals, is rotated to a second position between the left 70 and right 72 terminals; and the third tab 74, initially located on the right terminal 72, is rotated to the common terminal 68, completing a circuit through the switch between the center 110 and the left 112 conductors.

Successive plunger strokes will result in one of the tabs 74 coming to rest on the common terminal 68 while another of the tabs 74 comes to rest alternatively on the left 70 or right 72 terminals, completing a circuit through the switch between the common conductor 110 and alternatively the left 112 and right 114 conductors.

The nonmovement of the tabs 74 during the downstroke provides the switch with a tease free feature, as the state of the switch does not change during a partial downstroke of the plunger. Downstroke movement insufficient to move the hook 130 into engagement with the next successive camming surface 54, will not cause the switch to change state upon removal of such downstroke pressure.

While the preferred embodiment described above is directed to a single pole double throw switch, the present invention is not limited to use on this type of switch. In another preferred embodiment one of either the left 70 or right 72 terminals may be removed causing the switch to operate as a single pole, single throw switch.

Figure 13:
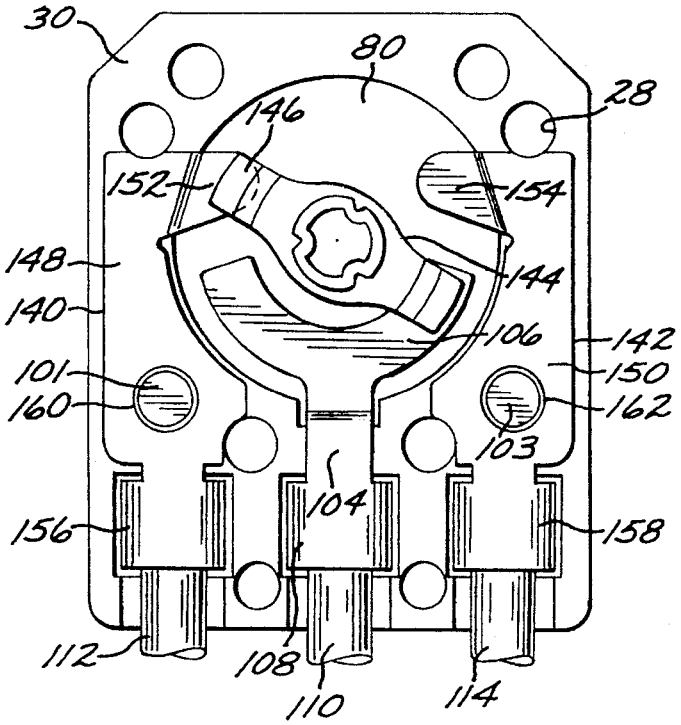
FIG. 13 is a top plan view of the cover portion of another embodiment of the present invention.

In another preferred embodiment, shown in FIG. 13, differently configured left 140 and right 142 terminals are utilized, together with a contact 144 having two tabs 146. In this embodiment the switch operates as an on-left, off and on-right switch. The left 140 and right 142 terminals each include, respectively, mounting portions 148 and 150, planar contact portions 152 and 154, crimped end portions 156 and 158, and locating holes 160 and 162. A center terminal contact portion 106 is configured to allow contact tabs 146 to alternatively connect the left or right terminal contact portions 152 and 154 with the center terminal contact portion 106. The terminals are held in place between the mating surface 24 and conforming surface 30 and are further secured in position by locating posts 101 and 103 which pass through the locating holes 160 and 162. The contact portions 152 and 154 are located within the arc described by the tabs 146 and are coplanar with the bottom of the circular recess 80. Each of the contact portions 152 and 154 have a surface area approximately equal to one of the tabs 146. The crimped end portions 156 and 158 are attachable to conventional electrical conductors 112 and 114 as described above.

Another preferred embodiment of the invention utilizes an actuator in the form of a bail rather than a pawl and is depicted in FIGS. 14 and 15. FIG. 14 shows the switch with the plunger 6 depressed, as indicated by the arrow A, while FIG. 15 depicts the switch with the plunger 6 in the fully extended position, as shown by the arrow B. The plunger 170 is adapted to conform to the bail 168 by incorporating two slots 169 in its sidewall located 180 degrees apart. The bail 168 is a generally U-shaped body with each arm 172 stepping outward in three portions and terminating in a hook 174. The bail 168 may be made of stainless or zinc coated carbon steel spring wire. The bail 168 is formed with an opening between the hooks 174 smaller than the diameter of the smaller end portion 44 of the ratchet 12. This results in the hooks 174 being continually urged towards the ratchet axis 62 by the spring tension of the bail 168. The operation of this embodiment is similar to that of the embodiment described above, but with two hooks 174 simultaneously engaging the ratchet 12 rather than just one. Also, the impetus for moving the hooks 174 across the camming surfaces 54 to the inner sidewall 59 is provided by the spring tension of the bail 168, rather than by action of the spring 10.

Another preferred embodiment of the invention, shown in FIGS. 16 and 17, eliminates the use of any separate actuating element and utilizes a portion of the plunger instead. A plunger actuator 176 is adapted to have an resilient member 178. A hook 180 is formed on the lower inner portion of the resilient member 178. The hook 180 is sized to displace the resilient member 178 a small amount when the hook 180 is located in an opening 58 of the ratchet 12. In operation the hook 180 engages the ratchet 12, as described above, with the impetus for moving the hook 180 across the camming surface 54 to the inner sidewall 59 being provided by the resilient member 178 returning to its original shape.

In another preferred embodiment, shown in FIG. 18, the switch operates as an on-left, on-right switch, also having an off position. Tripartite left 182 and right 184 terminals are utilized, in conjunction with a contact 186 having one tab 188. The left 182 and right 184 terminals each include, respectively, mounting portions 190 and 192, crimped end portions 194 and 196, and locating holes 198 and 200. The left terminal 182 additionally includes a spaced apart three portion planar contact having areas 202, 204 and 206. Interspersed between the contact areas of the left terminal are three spaced apart portions of the right terminal 184 comprising areas 208, 210 and 212. A center terminal 214 is employed having a crimped end portion 216 and a planer portion 218; the planer portion 218 being in continual communication with the contact 186. As with previously disclosed embodiments, the terminals are held in place between the mating surface 24 and conforming surface 30 and are further secured in position by locating posts 101 and 103 which pass through the locating holes 198 and 200. The contact areas 202–212 are located within the arc described by the tab 188 and are coplanar with the bottom of the circular recess 80. The crimped end portions 194, 196 and 216 are attachable to conventional electrical conductors 112, 114 and 110 as described above. This preferred embodiment is only one example of a switch of this type. By varying the shape and location of the left 182 and right 184 terminals, those skilled in the art may create other on-left, on-right and off switch operation sequences.

Another preferred embodiment is shown in FIG. 19. In this embodiment a provision is made to allow adjustment of the noise generated during the operation of the switch. A resilient stop 220, which terminates the outward movement of plunger 6, is provided at the end 221 of the barrel portion 18. The stop 220 is held in place by a threaded endcap 222, which has a partially closed end portion 224. The resiliency of the stop 220 reduces the impact force and therefore the noise generated as the plunger 6 impacts, then comes to rest against the stop 220 at the termination of the switch operation. The stop 220 is preferentially an open center disk in shape and covers all or nearly all of the area between the side 223 of the plunger 6 and the end portion 224. The stop 220 may be made of plastic or metal with hard stainless steel or copper alloy having a thickness of 0.002 to 0.010 inch being presently preferred. The stop 220 should be resistant to corrosion to insure long life. The stop 220 is retained on most or all of its outer circumference by the end portion 224, while a shoulder 225 of the plunger 6 contacts only an inner portion of the stop 220. A temporary elastic deformation of the stop 220 into a cone shape during switch operation provides the desired resiliency. The sound level made by the switch during operation may be adjusted by varying the material and thickness of stop 220.

Figure 20:
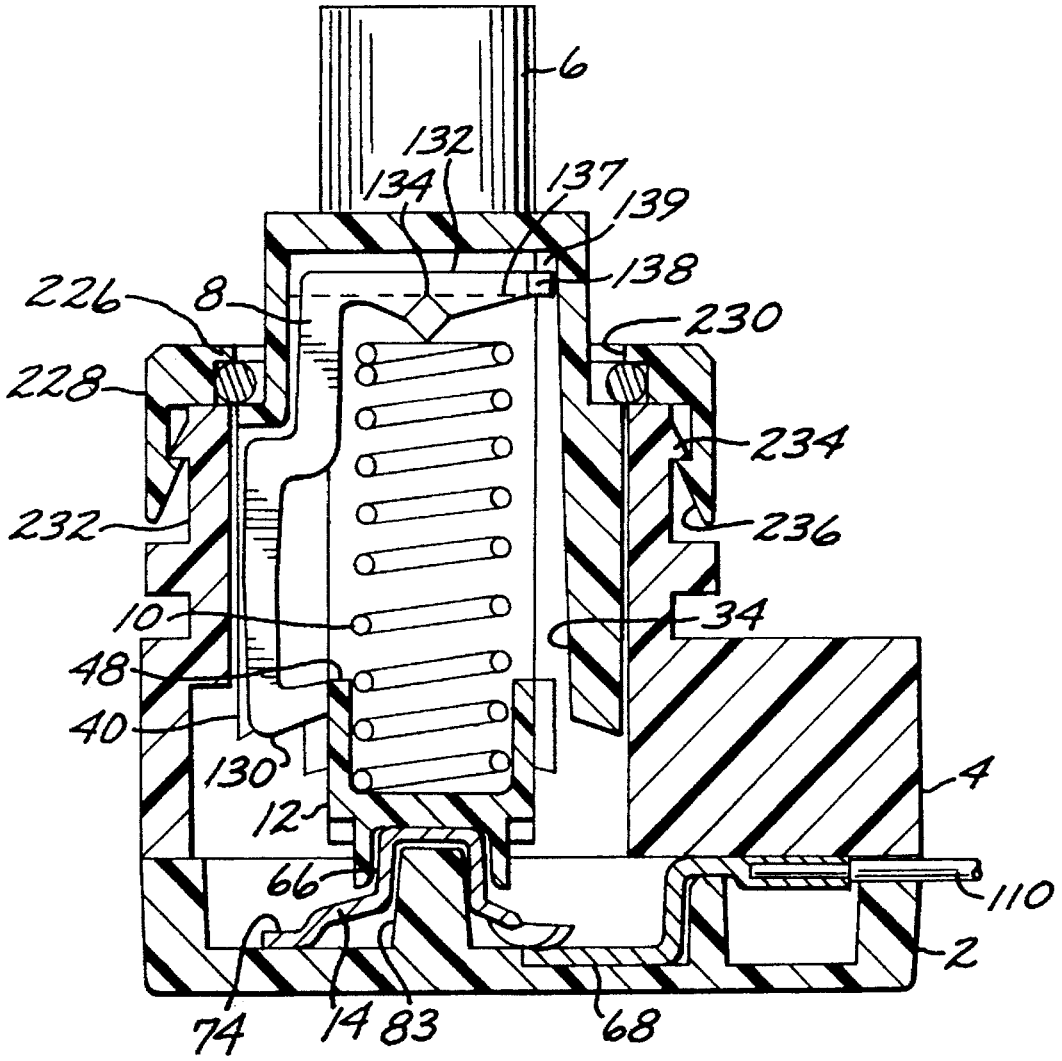
FIG. 20 is a sectional view of another embodiment of the present invention taken along line 11—11 of FIG. 1, with the plunger shown in the fully extended position.

Another preferred embodiment is shown in FIG. 20. An elastic ring 226 provided in place of an open center disk to provide the resilient stop. The ring 226 is preferentially made of an elastomer such as neoprene or the like and has a diameter of 0.020 to 0.060 inch. The ring 226 is circular in cross section, but may have a variety of other non-circular cross-sectional shapes. The operation of the ring 22 is similar to that of the stop 220 and provides a similar effect.

A resilient snap-fit endcap 228 is shown in FIG. 20 as retaining the ring 226. The endcap 228 has a partially open end portion 230 configured to enclose approximately one half the diameter of the ring 226. The barrel portion exterior 232 is configured to engage the endcap 228. A protrusion 234 of the external surface of the barrel portion surface 232 having inclined upper and horizontal lower surfaces, as depicted in FIG. 20, engages an oppositely configured protrusion 236 on the interior surface of the endcap 228 to provide an interference fit. While this snap-fit endcap 228 and conforming barrel portion surface 232 configuration is presently preferred, other snap-fit engagement configurations known in the art may be used.

In view of the foregoing, it will be appreciated that a variety of changes, modifications and variations may be made thereto without departing from the spirit and scope of the inventive concept expressed herein. For example, a differing number of camming surfaces 54 or a differing number or differently shaped terminals or tabs may be utilized. Actuators differently configured from the pawl 8, bail 172 or plunger actuator 176 may be utilized. The snap-fit endcap 228 and conforming barrel surface 232 may be used with any of the described embodiments. The cover 2 and body 3 may be held together by a bonding or welding process. Rotary and multiple pole single or multiple throw switches may be made incorporating the principles of the present invention. Accordingly, the above description should not be used to limit the scope of the invention as defined in the following claims.

What is claimed is:

1. A switch for completing an electrical circuit comprising:

a housing having an aperture;

a plunger mounted within the housing projecting outward through the aperture;

at least two terminals mounted within the housing connectable with the electrical circuit;

contact means mounted within the housing for interruptably bridging the terminals;

a ratchet comprised of one moving element mounted within the housing and having a plurality of rotationally overlapping helical camming surfaces;

actuating means mounted within the housing and interfacing with the plunger for indexing the ratchet in response to movement of a portion of the plunger into and out of the housing; and biasing means mounted within the housing for urging the plunger outward from the housing.

2. A switch for completing an electrical circuit comprising:

a housing having an aperture;

a plunger mounted within the housing projecting outward through the aperture;

at least two terminals mounted within the housing connectable with the electrical circuit;

contact means mounted within the housing for interruptably bridging the terminals;

a generally frustum shaped ratchet having a central axis, mounted within the housing for incrementally rotating the contact means, the ratchet including a plurality of expanding helical camming surfaces, each camming surface expanding radially from the central axis along its length;

actuating means mounted within the housing and interfacing with the plunger for indexing the ratchet means in response to movement of a portion of the plunger into and out of the housing; and biasing means mounted within the housing for urging the plunger outward from the housing.

3. The switch of claim 2 wherein the housing comprises a body and a cover.

4. The switch of claim 2 wherein the contact means comprises an electrically conductive disk having at least one tab extending radially outward from its circumference.

5. The switch of claim 4 wherein the contact means is pivotally mounted on an axial post extending away from an inner surface of the housing and in alignment with a central axis of the contact means.

6. The switch of claim 2 wherein each helical camming surface ends with a terminating face, the face in approximate radial and axial alignment with the central axis.

7. The switch of claim 2 wherein the actuating means comprises a pawl.

8. The switch of claim 2 wherein the actuating means comprises a bail.

9. The switch of claim 2 wherein the actuating means comprises the plunger having a resilient member and a hook.

10. The switch of claim 2 wherein the biasing means comprises a spring.

11. The switch of claim 2 additionally comprising a resilient stop for terminating the movement of the plunger out of the housing.

12. A switch for alternatively connecting a common lead to one of two electrical circuits comprising:

a housing having an aperture;

a plunger mounted within the housing projecting outward through the aperture;

a first terminal mounted within the housing connectable with the first electrical circuit;

a second terminal mounted within the housing connectable with the second electrical circuit;

a common terminal mounted within the housing connectable with the common lead;

contact means mounted within the housing for alternatively bridging the common terminal and one of the other terminals;

a generally frustum shaped ratchet having a central axis, mounted within the housing for incrementally rotating the contact means, the ratchet including a plurality of expanding helical camming surfaces, each camming surface expanding radially from the central axis along its length;

actuating means mounted within the housing and interfacing with the plunger for indexing the ratchet means in response to movement of a portion of the plunger into and out of the housing; and biasing means mounted within the housing for urging the plunger outward from the housing.

13. The switch of claim 12 wherein the housing comprises a body and a cover.

14. The switch of claim 12 wherein the contact means comprises an electrically conductive disk having at least one tab extending radially outward from its circumference.

15. The switch of claim 14 wherein the contact means is pivotally mounted on a post extending away from an inner surface of the housing and in alignment with a central axis of the contact means.

16. The switch of claim 12 wherein each helical camming surface ends with a terminating face, the face in approximate radial and axial alignment with the central axis.

17. The switch of claim 12 wherein the actuating means comprises a pawl.

18. The switch of claim 12 wherein the actuating means comprises a bail.

19. The switch of claim 12 wherein the actuating means comprises the plunger having a resilient member and a hook.

20. The switch of claim 12 wherein the biasing means comprises a spring.

21. The switch of claim 12 additionally comprising a resilient stop for terminating the movement of the plunger out of the housing.

22. A switch for completing an electrical circuit, the switch comprising:

a housing having a body and a cover, the body including a barrel portion;

a first and a second terminal mounted in the cover connectable with the electrical circuit;

a contact cup in communication with the first terminal, the cup having an end rotatibly mounted in the cover, the end having at least one tab extending radially away therefrom, the at least one tab interruptably communicating with the second terminal;

a generally frustum shaped ratchet having a central axis, mounted within the housing for incrementally rotating the contact cup, the ratchet including a plurality of expanding helical camming surfaces, each camming surface expanding radially from the central axis along its length;

an actuator mounted within the housing having at least one hook for engaging and rotatibly driving the rachet and the cup;

a plunger mounted within the housing and projecting through the barrel portion for driving the actuator; and a spring mounted in the housing for urging the plunger outward from the housing and the at least one tab into communication with the second terminal.

23. A switch for alternatively connecting a common lead to one of two electrical circuits, the switch comprising:

a housing comprising a body and a cover, the body having a barrel portion;

a first terminal mounted on the cover connectable with the first electrical circuit;

a second terminal mounted on the cover connectable to the second electrical circuit;

a common terminal mounted on the cover connectable with the common lead;

a contact cup having an end rotatibly mounted in the cover, the end having at least two tabs extending radially away therefrom, the tabs alternatively communicating with the common and one of the first and second terminals;

a generally frustum shaped ratchet having a central axis, mounted within the housing for incrementally rotating the contact cup, the ratchet including a plurality of expanding helical camming surfaces, each camming surface expanding radially from the central axis along its length;

an actuator mounted within the housing having at least one hook for engaging and rotatibly driving the rachet and the cup;

a plunger mounted within the housing and projecting through the barrel portion for driving the actuator;

a spring mounted in the housing for urging the plunger outward from the housing and the tabs into communication with the terminals.

* * * * *